US006126575A

United States Patent [19]

Wang

[11] Patent Number: 6,126,575

[45] Date of Patent: Oct. 3, 2000

[54] MODIFIED RACING EXERCISER

[76] Inventor: Leao Wang, No 1, Lane 154, Charng Long Rd., Taiping City, Taichung, Taiwan

[21] Appl. No.: 09/247,571

[22] Filed: Feb. 10, 1999

[51] Int. Cl.[7] ..... A63B 22/00

[52] U.S. Cl. ..... 482/54; 482/51

[58] Field of Search ..... 482/1–9, 51, 54, 482/900–902

[56] References Cited

U.S. PATENT DOCUMENTS

| | | | |
|---|---|---|---|
| 5,100,127 | 3/1992 | Melnick et al. | 482/54 |
| 5,318,491 | 6/1994 | Houston | 482/54 |
| 5,562,572 | 10/1996 | Carmein | 482/54 |
| 5,752,897 | 5/1998 | Skowronski et al. | 482/54 |
| 5,800,314 | 9/1998 | Sakakibara et al. | 482/54 |
| 5,919,119 | 7/1999 | Bohmer et al. | 482/54 |

*Primary Examiner*—Glenn E. Richman
*Attorney, Agent, or Firm*—Dougherty & Troxell

[57] ABSTRACT

A jogging exerciser with a self-retractable rope hitched to the runner, and a sensor to detect the location of said rope while instantly transmitting positive or negative voltage to a micro-computer central processor. The processor then gives a command of acceleration or deceleration to a motor driving a running belt to immediately control its rpm to cope with runner's exercising speed for a more life-like and human situation.

2 Claims, 2 Drawing Sheets

MODIFIED RACING EXERCISER

BACKGROUND OF THE INVENTION

1. Field of the Invention

The present invention relates to a racing exerciser, and more particularly to one with its motor rpm automatically increasing or decreasing to synchronize with the running speed of its runner for a more real-life running context.

2. Description of the Prior Art

Whereas a running exerciser relates to an excellent exerciser for a runner to run along on a continuously motor-driven belt operating on a pair of front and rear rollers without actually running forward so that the runner runs on the belt with a pace depending on its rpm. In practice, the runner presses a power key to start the motor, thus the belt runs for stationary cycling with a motor rpm to be set by pressing Acceleration/ Deceleration control keys on an electronic instrument panel provided in front of the runner who then runs along on the belt at a rate set up by the motor (i.e. by the belt). Once the runner desires to increase or decrease his/her pace, he/she has to press either of the corresponding Acceleration/ Deceleration control keys as the case may be. That is, the runner has to repeat pressing the control keys during the exercise so to achieve his/her purpose for various training needs including warm-up, running at a given pacing, dashing, and jogging trot.

The actual motion status and needs of the runner should dominate over the running exerciser. However, in the prior art, the motion of the running exerciser of the prior art forces the runner to compromise to the rpm of the exerciser, instead of the other way around.

SUMMARY OF THE INVENTION

The primary objective of the present invention is to provide a running exerciser that allows the running motion mechanism to automatically adapt to the motion status and needs of the runner by immediately accelerating or decelerating synchronously with the pacing of the runner. The position of the runner, assumed to be at the center of the exerciser when starting, varies depending on changes in his/her running speed due to the fact that the runner's position running on the belt will not change if his/her running speed is the same as that of the rpm of the belt. The position moves forward if his/her running speed is greater than the latter, and backward if it is lower.

DETAILED DESCRIPTION OF THE INVENTION

Figure 1:
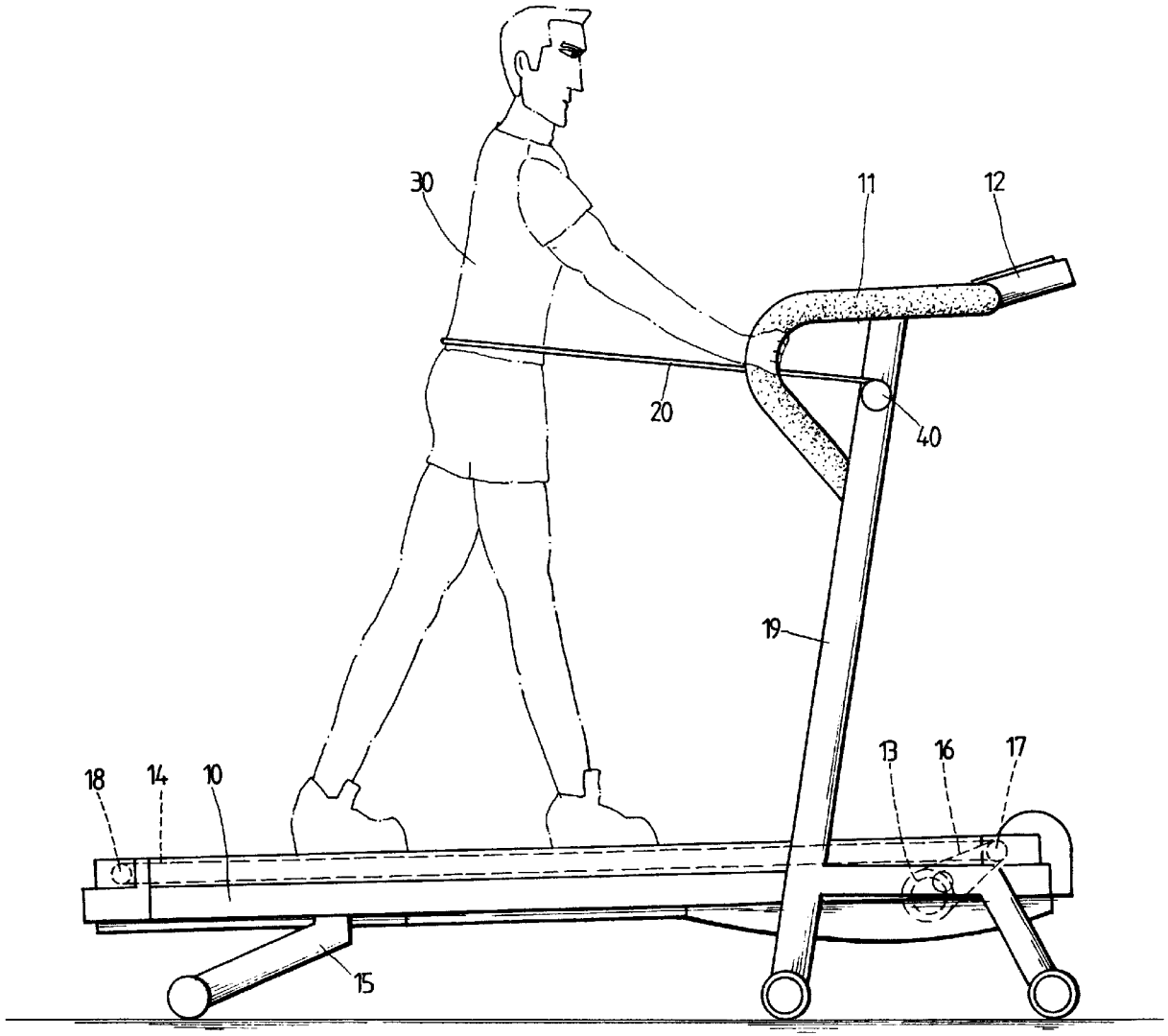
FIG. 1 is a view of a preferred embodiment of the present invention.

Referring to FIG. 1 for a preferred embodiment of the present invention, the present invention is essentially comprised of a mainframe 10, a hand rest 11, an electronic instrument panel 12, a motor 13, a running belt 14, a drive belt 16, a front roller 17, a rear roller 18, a rear supporting rod 15 and a rope 20. The belt 16 drives the front roller 17 while the running belt 14 is wrapping around the front roller 17 and the rear roller 18 continuously roll due to the transmission from the motor 13. The rope 20, which is automatically retractable, is provided on a post 19 of the mainframe 10 and is hitched to a runner 30, and a sensor device 40 is provided to detect the location of the rope 20. The sensor device 40 in turn promptly transmits positive or negative voltage to a micro-computer central processor located in the electronic instrument panel 12, then the central processor gives the command of either acceleration or deceleration to the motor 13 for an immediate control of the rpm of the running belt 14 so that a running exerciser of the present invention will be automatically tuned to the pacing of the runner 30.

Figure 2:
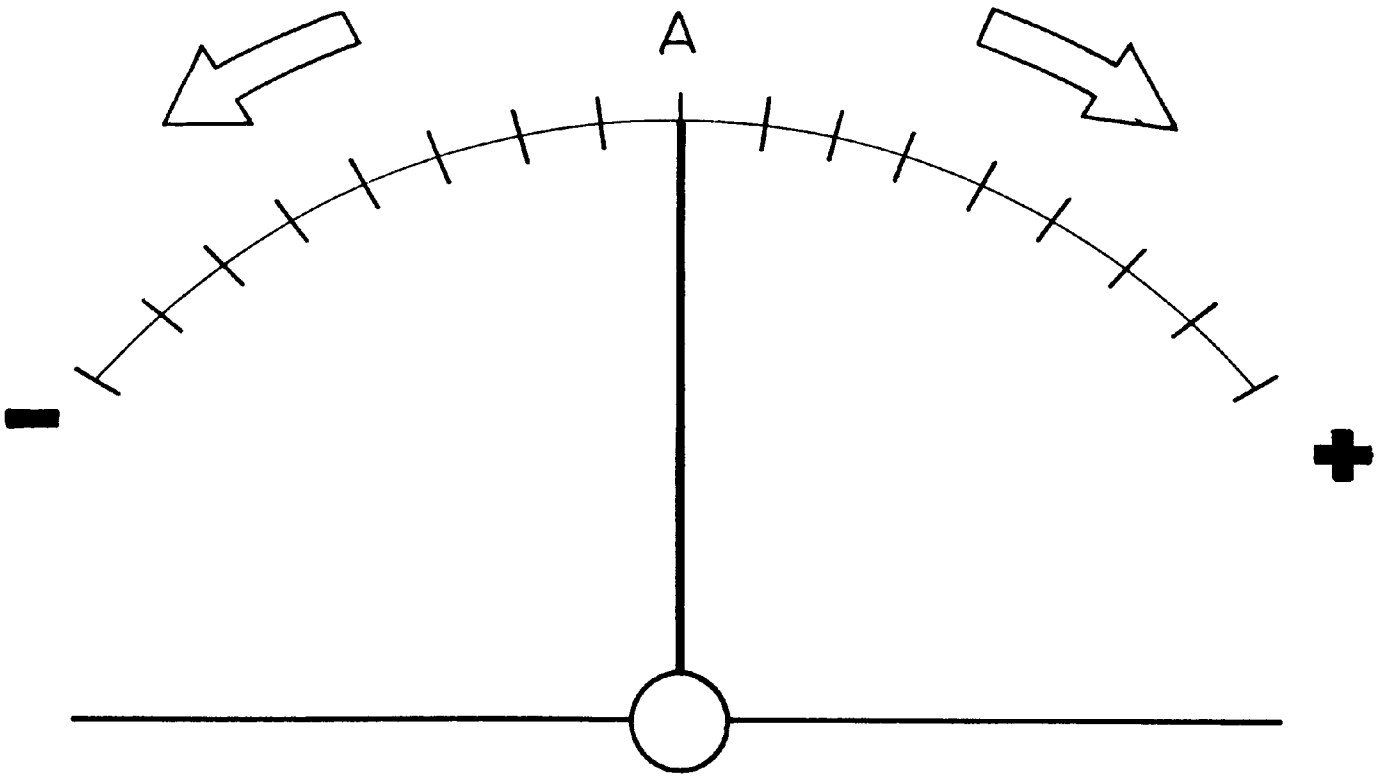
FIG. 2 is a schematic view showing the working principles and operation status of a sensor to the preferred embodiment of the present invention.

Now referring to FIG. 2 for the working principles and operation of the sensor device 40, within, the central point A is used as a reference point to indicate when the runner 30 is located at the central position on the mainframe 10. Once a value leaning to the right of Point A, i.e., the rope 20 is retracted, the central processor sends the command of acceleration to the motor 13; and when the value leans to the left of Point A, i.e., the rope 20 is pulled out, the central processor sends the command of deceleration to the motor 13. Therefore, once the pacing of the runner 30 is faster than the rpm of the running belt 14, the body of the runner 30 gradually moves forward towards the mainframe 10 in front of the central position of the mainframe 10. At this time, the rope 20 is retracted and the sensor device 40 detects the change in the location of the runner 30, and if the value of voltage outputted from the sensor device 40 is present as positive, the central processor immediately sends the command of acceleration to the motor 13. On the contrary, if the pacing of the runner 30 is slower than the rpm of the running belt 14, the body of the runner 30 gradually moves behind the central position of the mainframe 10. At this time, the rope 20 is pulled out and the sensor device 40 detects the change in the location of the runner 30. If the value of voltage outputted from the sensor device 40 is preset as negative for the status when the rope 20 is pulled out, the central processor immediately sends the command of deceleration to the motor 13.

When the value of the rope 20 detected by the sensor device 40 continues to lean to the right of Point A, the motor 13 keeps increasing its rpm for the running belt to operate at an rpm slightly higher than that of the speed of the runner 30, to return the location of the runner 30 back to the central point of the mainframe 10, i.e. Point A, and the acceleration is terminated once the running 30 returns to Point A when the rpm of the running belt 14 is identical to that of the speed of the runner 30. At this time, the rpm of the running belt is slightly higher than before the acceleration to cope with the increased pacing speed of the runner 30. Similarly, once the value detected by the sensor device 40 continuously leans to the left of Point A, the motor 13 maintains its deceleration until the runner 30 returns to the central location of the mainframe 10, to cope with the slowing down by the user 30.

To ensure a true re-adjustment of the rpm of the motor 13 for acceleration or deceleration, both positive and negative voltages detected by the sensor device 40 are divided into several grades; that is, when within a given unit of time, the greater the grade of positive (negative) voltage, the acceleration (deceleration) rate by the motor 13 increases (decreases) accordingly. For example, if the runner 30 gives a sudden increase up to 10 km/hour from 5 km/hour, the voltage output detected by the sensor device 40 gets larger, the acceleration rate by the motor 13 increases to a larger extent, or a mild increase if the increase of the speed by the runner 30 is just up to 6 km/hour as the voltage value detected is at a lesser grade.

A display (not shown in the accompanying drawings) may be provided on the mainframe 10 or elsewhere within the convenient visual contact of the runner 30 for him/her to always know his location on the mainframe 10 so to make adjustment of either accelerating or decelerating the speed of the running belt 14.

What is claimed is:

1. A system for automatically adjusting the speed of a running belt on a treadmill having a main frame with an upwardly extending hand rest, and an endless running belt movably mounted on the main frame, the system comprising:

a) a motor driving the running belt;

b) a central processing unit in an instrument panel on the hand rest, the central processing unit controlling the speed of the motor which, in turn, controls the speed of the running belt;

c) a sensor device mounted on the hand rest; and, d) a rope automatically retractably connected to the sensor device and extendable therefrom so as to be maintained in an initial extended position by a runner running on the running belt, whereby the sensor detects retraction of the rope from the initial extended position indicating the runner's pace is faster than the pace of the running belt, thereby moving the runner forward on the running belt, the sensor sending a first signal to the central processing unit to increase the speed of the motor and running belt until the rope has returned to the initial extended position, and whereby the sensor detects extension of the rope from the initial extended position indicating the runner's pace is slower than the pace of the running belt, thereby moving the runner backward on the running belt, the sensor sending a second signal to the central processing unit to decrease the speed of the motor and running belt until the rope has returned to the initial extended position.

2. The system of claim 1 further comprising:

a) front and rear rollers on the main frame movably supporting the running belt on the main frame; and, b) a driving belt drivingly connecting the motor to one of the front and rear rollers.

* * * * *